US005821451A

United States Patent [19]

Stephenson et al.

[11] Patent Number: 5,821,451

[45] Date of Patent: Oct. 13, 1998

[54] PHOTOFLASH PARTICLE MIXTURE

[75] Inventors: Stanley W. Stephenson, Spencerport; Kimon Papadopoulos, Penfield, both of N.Y.

[73] Assignee: Eastman Kodak Company, Rochester, N.Y.

[21] Appl. No.: 769,338

[22] Filed: Dec. 19, 1996

[51] Int. Cl.[6] ..... C06B 45/02; C06B 33/06; F23Q 3/00

[52] U.S. Cl. ..... 149/19.1; 149/21; 149/42; 149/108.2; 149/109.2; 149/114; 431/362

[58] Field of Search ..... 431/362; 149/19.1, 149/108.2, 21, 42, 109.2, 114

[56] References Cited

U.S. PATENT DOCUMENTS

| | | | |
|---|---|---|---|
| 2,285,125 | 6/1942 | Pipkin | 431/362 |
| 3,232,194 | 2/1966 | Ostrow . | |
| 3,751,656 | 8/1973 | Buckler et al. | 240/1.3 |
| 3,771,941 | 11/1973 | Audesse et al. | 431/93 |
| 3,807,934 | 4/1974 | Lukas et al. | 431/92 |
| 3,820,940 | 6/1974 | Buzalski et al. | 431/93 |
| 3,914,143 | 10/1975 | Sterling | 149/40 |
| 3,955,911 | 5/1976 | Roelevink | 431/93 |
| 3,972,673 | 8/1976 | Schupp | 431/362 |
| 4,152,105 | 5/1979 | Ramsay | 431/359 |
| 4,152,106 | 5/1979 | Haraden | 431/359 |
| 4,201,540 | 5/1980 | Waymouth et al. | 431/361 |
| 4,233,023 | 11/1980 | Johnson et al. | 431/362 |
| 4,315,733 | 2/1982 | Bouchard et al. | 431/362 |
| 4,363,622 | 12/1982 | van Laarhoven | 431/362 |
| 4,369,028 | 1/1983 | Bricker et al. | 431/362 |
| 4,382,775 | 5/1983 | Bouchard | 431/362 |
| 4,424,020 | 1/1984 | Bouchard et al. | 431/359 |
| 4,432,724 | 2/1984 | Bouchard et al. | 431/362 |
| 4,457,700 | 7/1984 | Bouchard et al. | 431/362 |
| 4,659,308 | 4/1987 | Sindlinger | 431/362 |
| 4,696,641 | 9/1987 | Shaffer et al. | 431/362 |

FOREIGN PATENT DOCUMENTS

| | | |
|---|---|---|
| 976061 | 11/1964 | United Kingdom . |
| 1515404 | 6/1978 | United Kingdom . |
| 1538119 | 1/1979 | United Kingdom . |

*Primary Examiner*—Peter A. Nelson
*Attorney, Agent, or Firm*—Paul A. Leipold

[57] ABSTRACT

The invention relates to a photoflash mixture comprising a mixture of particles of zirconia and at least one oxidizer, wherein said zirconia particles comprise a mixture of smaller particles between about 2 and 10 $\mu$m diameter, and larger particles between about 20 and 30 $\mu$m average diameter.

22 Claims, 1 Drawing Sheet

PHOTOFLASH PARTICLE MIXTURE

FIELD OF THE INVENTION

The invention relates to photoflash lamps and particularly to photoflash lamps utilizing an explosive mixture of particles. It particularly relates to a mixture of particles that is electrically activated.

BACKGROUND OF THE INVENTION

When taking photographic pictures there is a need for a light to provide sufficient illumination to allow taking of the picture in naturally low light conditions. This generally has been done in several ways. In a studio, electric lights are used; in cameras, electric strobes are commonly used. Further, in portable cameras, scene illumination has been provided by combustive mixtures of metal particles.

U.S. Pat. No. 4,382,775—Bouchard, U.S. Pat. No. 4,315,733—Bouchard et al, U.S. Pat. No. 4,233,023—Johnson et al, and U.S. Pat. No. 3,751,656—Buckler et al each disclosed combustive photoflash devices. These devices comprise a powdered metal and an oxidizer. These devices are activated electrically using conductive lead-in wires.

Problem to be Solved by the Invention

While the prior photoflash devices have been successful for photoflash illumination, there remains a need to have reliable, primerless detonation of mixtures using a single AA battery within a single use camera having high speed color negative film. Further, there is a need for more effective combinations of oxidizer and powdered metal. Improved combinations would ignite reliably and burn more efficiently to provide more effective low cost illuminating mixtures.

SUMMARY OF THE INVENTION

An object of the invention is to provide reliable activation of flash mixtures using a single AA battery without the use of a second primer material.

It is a further object to provide explosive flash devices that are efficient, effective, small, and safe.

It is yet a further object to use particles that are commercially available without secondary process in a manner that provides reliable, high output ignition without a primer material and using a low cost AA battery for ignition.

These and other objects are generally accomplished by a photoflash mixture comprising a mixture of particles of zirconia and at least one oxidizer, wherein said zirconia particles comprise a mixture of smaller particles between about 2 and 10 $\mu$m diameter, and larger particles between about 20 and 30 $\mu$m average diameter.

In a preferred embodiment of the invention, the explosive photoflash mixture is provided in a photoflash element for use in a single use camera.

Advantageous Effect of the Invention

The invention provides an efficient combustion of a flash mixture. The mixture of the invention provides a flash that is compatible with commercial color negative films of a speed of about 800 and provides adequate exposure for use in snapshot situations. The invention also provides low cost, efficient light.

DETAILED DESCRIPTION OF THE INVENTION

The invention has numerous advantages over prior photoflash mixtures and elements. The flash of the invention provides light over a time period that is desirable for compatibility with color negative films. Further, the flash mixture is efficient, and as it is efficient, it is lower in cost. The materials further may be easily ignited with minimum power requirements. These and other advantages will be apparent from the detailed description below.

Figure 1:
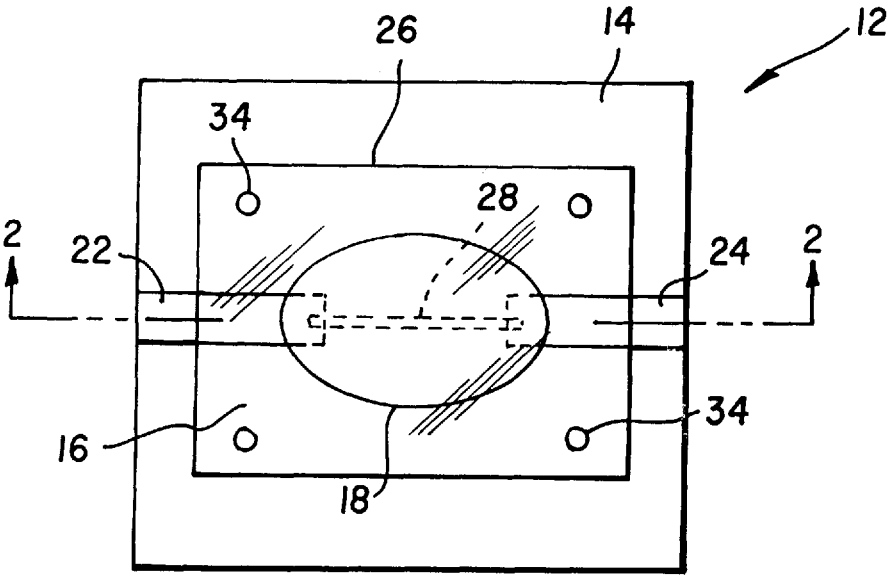
FIG. 1 is a top view of the photographic mixture of the invention arranged with an ignition wire.
Figure 2:
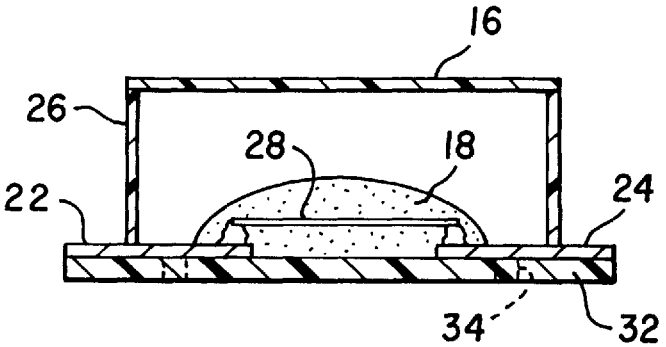
FIG. 2 is a cross section of FIG. 1 indicating the arrangement of the invention photoflash mixture and the ignition wire and cavity for the mixture.

Illustrated in FIG. 1 is a top view of an element employing the photoflash material of the invention. The element 12 is comprised of a base 14, transparent cover 16, photoflash mixture 18, conductive ignition strips 22 and 24, and vertical sides 26. As shown on cross section line 2—2 in FIG. 2, the photoflash material 18 is in a mound which contains ignition wire 28. Also shown in FIG. 2 is base member 32 which is provided with holes for exhaust gas such as 34 in FIG. 1. When the explosive mixture 18 is ignited by heating through conductor members 22 and 24 such that ignition wire 28 becomes hot enough for ignition of photoflash material 18, then combustion occurs which releases light through transparent cover 16 in order to light a photographic scene.

The photoflash material of the invention is comprised of a mixture of particles of zirconia and at least one oxidizer. The oxidizer may be any suitable material. The oxidizer generally is selected from potassium perchlorate ($KClO_4$), potassium chlorate ($KClO_3$), and sodium chlorate ($NaClO_3$). Preferred is the perchlorate, as it is not hydrophilic, provides oxygen readily, is effective, and low in cost. To create particles with constant burn characteristics, the $KClO_4$ is passed through a 200 sieve and retained by a 400 sieve. This ensures that the oxidizer particles fall between 40 and 100 $\mu$m. The zirconia mixture is a combination (blend) of large particles and small particles. The commercially available small particles that comprise an average size of between and about 2 and about 10 $\mu$m. In a preferred embodiment, the small particle is of about 3 $\mu$m in average size with a range of sizes such that 90% of the particles are between about 1 and 6 $\mu$m. The larger particles of zirconia are generally between about 20 and 30 $\mu$m average particle diameter with a preferred size being an average of 25 $\mu$m with 90% of the particles being between 12 and 60 $\mu$m and greater than 50% of the particles being between 20 and 50 $\mu$m.

The mixture of large and small particles is generally such that between about 1 and about 50 weight % of said zirconia particle mixture is the fine particles with the remainder the large particles. It is preferred that the fine zirconia be present in an amount between about 20 and 35% by weight of the zirconia present in the mixture. If less than 15% of the mixture is fine zirconium, the mixture cannot be ignited by a single AA alkaline battery. This makes the mixture unusable in a low-cost single use camera. Mixtures containing high amounts of fine zirconium become explosive. As a result, the energy that is released is released kinetically instead of as light. Output falls off and explosive noise increases above 35% zirconium. Weight percent of the fine zirconium can be varied to increase burn times to match a fixed shutter open time in a single use camera of 10 milliseconds. Varying percent weight fine zirconium also varies total output per unit mass.

The oxidizer generally is utilized in any suitable amount for maximum flash effectiveness. Generally the oxidizer is utilized in an amount of about 20% above stoichiometry for best performance.

In a preferred form, the mixture of large and small zirconia particles is combined with a polymer in an aqueous solution. After laydown and drying, the polymer controls the burn rate, as well as anchor the particles over the ignition wire. The polymer is selected in an amount of between about 0.01 and 1% by weight of the total mixture of polymer and particles. The preferred range is between about 0.05 and 0.15% polymer to total mixture of polymer and particles for good light output.

The polymer may be selected from any suitable material. Generally the suitable polymers are acrylics, polyvinyl alcohol, and polyacrylamides. A preferred material has been found to be low molecular weight polyacrylamide because it allows the effective burn rate to emit the desired amount of light.

Generally the amount of polymer in the particles is adjusted such that the burn flash time will be for a time of burn between 5 and 10 microseconds. This allows effective light emission to expose a color negative film and minimize camera shake.

With the combined large and small particle size zirconia of the invention in a polymer binding, it has been found that about 40 mg of the total particle mixture and polymer are necessary to provide enough light to expose a 800 ASM speed film for a subject about 10 feet from the camera.

The ignition wire of the element of the invention may be any suitable material. Wire may be suitably copper, gold, tungsten, or aluminum. The preferred wire is copper, as it is easy to work with, effective, and low in cost.

The following examples illustrate the practice of this invention. They are not intended to be exhaustive of all possible variations of the invention. Parts and percentages are by weight unless otherwise indicated.

EXAMPLES

In a first experiment, 3 micron Zirconium particles were mixed in various proportions with sieved zirconium particles having a mean particle size of 40 microns. Sieved $KClO_4$ with a particle size 100 to 200 microns was added to each mixture of zirconium. Distilled water was added in on a 1:1 ratio with the mixture weight. A test board was used to determine the properties of each mixture. The board had eight sites, each site having a 5 micron, 25 micron diameter copper wire connectable to a 1.5 volt AA alkaline battery. Approximately 80 milligrams of mixture were applied to each of eight sites on a test board. The mixture was oven dried at 90° C. for 24 hours, leaving a dry mixture of 40 milligrams at each site. Each site was then covered by a hemispherical glass shell 1 millimeter thick and having an internal volume of approximately 1 cc. The 1.5 volt alkaline battery was connected to each cell to determine whether the mixture would ignite. A light sensor above each cell measured light output in volts and light duration in milliseconds. Sound was measured by an observer as "soft" or "loud". The results are summarized in Table 1 below:

TABLE 1

| TEST | Fine Zr (mg) | Crse Zr (mg) | KClO4 (mg) | # ignited | Vpeak (volts) | tburn (msec) | Output (mVs) | Sound |
|---|---|---|---|---|---|---|---|---|
| 1 | 0 | 50 | 45 | 3/8 | 0.8 | 40 | 10 | soft |
| 3 | 15 | 35 | 45 | 8/8 | 4.2 | 12.6 | 53 | soft |
| 3 | 25 | 25 | 45 | 8#8 | 4.5 | *7.3 | 33 | LOUD! |

The mixture without fine zirconium ignited only 3 out of eight times. The mixture burned for a long time without much light output. When fine zirconium was 30 percent of the zirconium, noise levels were low, burn times were much shorter at 12 milliseconds, and light output was good. Increasing fine zirconium to 50 percent of the weight of zirconium resulted in a loud noise and reduced light output.

The experiment was repeated using different ratios of fine and coarse zirconium and different ratios of $KClO_4$ oxidizer. Five mixtures were made that incorporated 20, 30, and 40 percent fine zirconium with the remainder coarse Zirconium and 1:1.2, 1:05, and 1:0.9 ratios of zirconium to oxidizer. The powder was mixed in equal weights with distilled water carrying 0.1% low molecular weight poly-acrylamide. The mixtures were deposited and dried to yield a 40 milligram deposit. The five experimental mixtures are numbered in the Table 2 below:

TABLE 2

| | Percent Fine Zr | | |
|---|---|---|---|
| Oxidizer/Ratio | 20% | 30% | 40% |
| 1.20 | Mix #1 | | Mix #2 |
| 1.05 | | Mix #3 | |
| 0.90 | Mix #4 | | Mix #5 |

Each mixture was deposited on 12 sites and fired using a single AA alkaline battery. Output was recorded in millivolt-seconds. No data was obtained for mixture 2 because all the cells ruptured on ignition of the first cell due to the volatility of the mixture. The output of the 12 cells was averaged to compute a mean output and is entered into the table. The results are below in Table 3:

TABLE 3

| | Percent Filler Zr | | |
|---|---|---|---|
| Oxidizer/Ratio | 20% | 30% | 40% |
| 1.20 | 6.67 | | BOOM* |
| 1.05 | | 8.52 | |
| 0.90 | 5.40 | | 7.17 |

*cell ruptured

The output of the 12 cells was averaged to compute a mean output and is entered into Table 3. It is apparent that as the percentage of fine zirconium and the amount of oxidizer increase, output increases. Optimum ratios appear to be about 30 percent fine zirconium and near or about stoichiometry of oxidizer. Increasing fine zirconium and amount of oxidizer above certain ratios results in explosions.

The invention has been described in detail with particular reference to preferred embodiments thereof, but it will be understood that variations and modifications can be effected within the spirit and scope of the invention.

We claim:

1. A photoflash element comprising a base provided with holes for exhaust gas, a photoflash mixture comprising a mixture of particles of zirconia and at least one oxidizer, wherein said zirconia particles comprise a mixture of smaller particles between about 2 and 10 μm average diameter, and larger particles between about 20 and 30 μm average diameter, ignition means, and containment means having a transparent cover.

2. The element of claim 1 wherein said element further includes an ignition wire.

3. The element of claim 2 wherein said smaller particles comprise between about 15 and 35 weight percent of the total of said zirconia particles.

4. The element of claim 2 wherein said small particles comprise between 1 and 50 weight percent of the total of said zirconia mixture.

5. The element of claim 2 wherein said at least one oxidizer is selected from the group consisting of $KClO_4$, $KClO_3$, and $NaClO_3$.

6. The element of claim 2 wherein said oxidizer is utilized in an amount near stoichiometry.

7. The element of claim 2 further comprising a polymer.

8. The element of claim 7 wherein said polymer controls burn rate to give a flash burn time of about 10 microseconds.

9. The element of claim 8 wherein said mixture comprises between about 0.01 and 0.50 percent by weight of polymer.

10. The element of claim 7 wherein said polymer comprises at least one member selected from the group consisting of acrylic, polyvinyl alcohol, and polyacrylamide.

11. The element of claim 10 wherein said polymer comprises between about 0.01 and 0.50 percent by weight of said mixture.

12. The element of claim 2 wherein said small particles are about 3 μm in diameter and said larger particles about 25 μm in diameter.

13. The element of claim 8 wherein said smaller particles comprise between about 20 and 35 weight percent of the total of said zirconia mixture.

14. The element of claim 4 wherein said at least one oxidizer is selected from the group consisting of $KClO_4$, $KClO_3$, and $NaClO_3$.

15. The element of claim 14 wherein said oxidizer is utilized in an amount near stoichiometry.

16. The element of claim 3 further comprising a polymer.

17. The element of claim 16 wherein said mixture has a burn rate to give a flash of about 10 microseconds.

18. The element of claim 3 wherein said mixture comprises between about 0.01 and 0.50 percent by weight of a polymer.

19. The element of claim 18 wherein said polymer comprises at least one member selected from the group consisting of acrylic, polyvinyl alcohol, and polyacrylamide.

20. The element of claim 16 wherein said polymer comprises between about 0.01 and 0.50 percent by weight of said mixture.

21. The element of claim 17 wherein said small particles are about 3 μm in diameter and said larger particles are about 25 μm in diameter.

22. The element of claim 19 wherein said smaller particles comprise between 1 and 50 weight percent of the total of said zirconia mixture.

* * * * *